United States Patent [19]

Berg et al.

[11] Patent Number: 4,943,168

[45] Date of Patent: Jul. 24, 1990

[54] PACKAGE BAND

[75] Inventors: Sven-Olof Berg, Haverdal; Ingemar Broden, Halmstad, both of Sweden

[73] Assignee: Pronova AB, Halmstad, Sweden

[21] Appl. No.: 217,635

[22] Filed: Jul. 12, 1988

[30] Foreign Application Priority Data

Jul. 13, 1987 [SE] Sweden ..... 8702838

[51] Int. Cl.[5] ..... B65D 30/22

[52] U.S. Cl. ..... 383/38; 206/820

[58] Field of Search ..... 206/526, 820, 3; 221/78, 79; 414/403, 409, 417; 198/713, 714, 715; 53/459; 383/38

[56] References Cited

U.S. PATENT DOCUMENTS

| | | | |
|---|---|---|---|
| 3,160,273 | 12/1964 | Reuther et al. | 206/820 |
| 3,162,539 | 12/1964 | Repko | 206/820 |
| 3,348,762 | 10/1967 | Kasinkas | 206/820 |
| 3,583,127 | 6/1971 | Marchand | 53/459 |
| 3,599,388 | 8/1971 | Feingold | 53/459 |
| 3,779,449 | 12/1973 | Membrino | 206/820 |
| 4,630,311 | 12/1986 | Bentson | 206/820 |

FOREIGN PATENT DOCUMENTS

| | | | |
|---|---|---|---|
| 1548768 | 10/1968 | France | 206/820 |

*Primary Examiner*—Paul T. Sewell

*Attorney, Agent, or Firm*—Ladas & Parry

[57] ABSTRACT

A package band (10) is formed of two walls (11*a*, 11*b*) substantially adjoining one another and made of a flexible material, e.g. plastic material. Each one of the walls extends from a first edge area (12*a*, 12*b*) the longitudinal direction of the package band to a bottom edge (23) common to the walls situated in a second edge area (14) of the package band. By forming joints (15) located transversely to the longitudinal direction of the package band storage pockets (16) are formed one behind another. Each one of the walls is provided in its first edge area (12*a*, 12*b*) with a first connecting tunnel (17*a*, 17*b*) adapted to co-operate with a filling or emptying equipment. In its second edge area (14) the package band is provided with a second connecting tunnel (18) adapted to cooperate with a mechanical element of the filling or emptying equipment.

5 Claims, 9 Drawing Sheets

PACKAGE BAND

FIELD OF THE INVENTION

The present invention relates to a band with pockets situated in adjoining relation, one after another along the length of the band.

FIELD OF THE INVENTION

There is a need in industrial usage for packages which are adapted to co-operate with equipment which, e.g. in manufacturing processes, continuously or intermittently conveys components and/or parts to a certain position from which they can be picked up in each individual case of assembly in order to be fitted to the product in the course of manufacture. In this context it is necessary in many applications for the components or parts to be protected prior to assembly as long as possible from contamination and pollution. Frequently, there is also a demand that the parts should be made accessible in batches, the number of parts included in each batch to correspond to the number which is to be assembled in each individual case of assembly. In certain phases of manufacture, it is desirable that the parts which are to be assembled should be removed from the packages by mechanical means and in addition to this in certain applications also that the parts, after they have been removed from the packages, should be mutually in order and position so that e.g. a robot can be adjusted in order to pick up and assemble them.

From EP No. 54 564 is known a band formed from two walls of flexible material situated in adjoining relation to one another which are united by means of transverse joints so as to form package blanks arranged one behind another and which are adapted so that after filling and closure they are detached from one another so as to form separate packages. However, the packages obtained from the band are not suitable to be emptied of their contents so as to satisfy the abovementioned requirements and demands.

SUMMARY OF THE INVENTION

By means of the present invention a package is disclosed which does satisfy the objects and demands stated. It is a particularly valuable feature of the present invention that it makes possible a simple and rational production of the package band, a simple insertion of the parts into its pockets and a simple subsequent closure of the pockets filled with parts and, finally, a rational opening and withdrawing of the parts from the pockets.

The aforementioned requirements are satisfied and the demands indicated are met by a package band in accordance with the claim 1.

BRIEF DESCRIPTION OF THE FIGURES OF THE DRAWING

The invention is described in more detail in connection with the drawing, wherein.

DETAILED DESCRIPTION OF PREFERRED EMBODIMENTS

Figure 1:
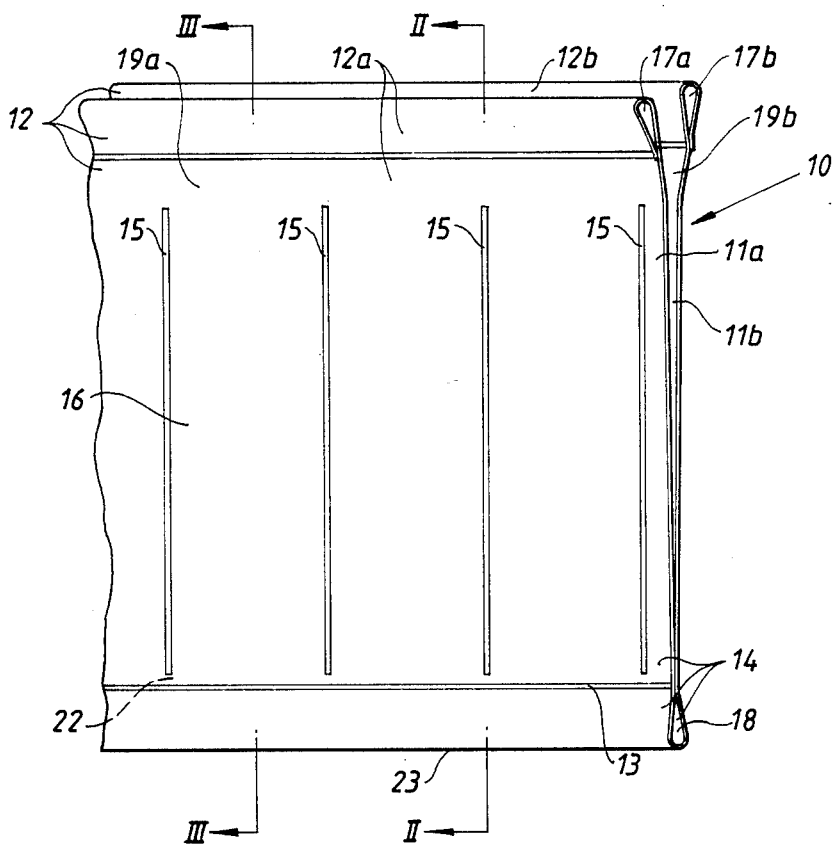
FIG. 1 is a perspective view of a portion of a package band according to the invention.
Figure 3:
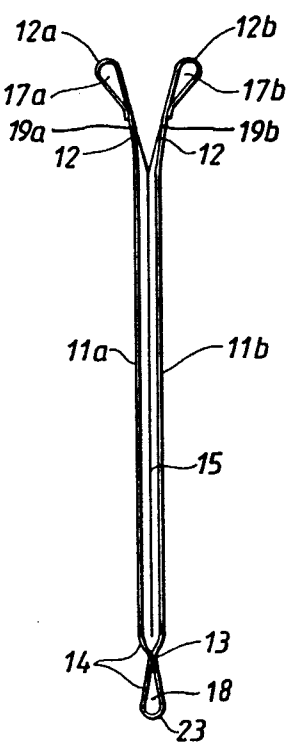
FIG. 3 is a section taken on line III—III in FIG. 1.
Figure 2:
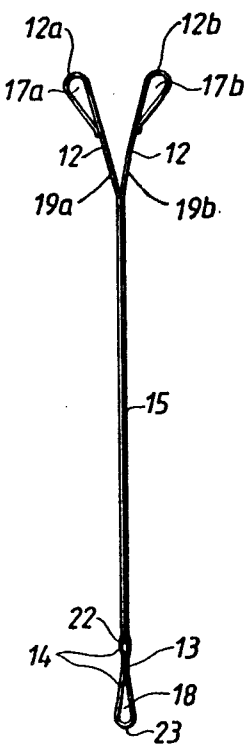
FIG. 2 is a section taken on line II—II in FIG. 1.

In FIGS. 1–3 is shown an embodiment of a package band 10 formed of flexible material, as a rule plastic material. The band of flexible material has been folded over so that on the package band two walls 11*a*, 11*b* placed substantially adjoining one another are formed, referred to hereinafter generally as first wall 11*a* and second wall 11*b*, respectively. Each of the walls has a first edge area 12*a* and 12*b*, respectively. These two edge areas together form the first edge area 12 of the package band. Each one of the first edge areas 12*a* and 12*b*, respectively of the walls is provided with a connecting means 17*a*, 17*b*, which in the figures is in the form of a tunnel 17*a*, 17*b*. In conjunction with the second edge area 14 of the package band the two walls blend into one another in a transition 23.

A joint 13 arranged in the longitudinal direction of the band attaches the walls to one another in an area inside of, and parallel to, the transition 23 of the band. As a result a tunnel 18 is formed between the joint 13 and the transition just mentioned, which constitutes a second connecting means 18 on the package band. Substantially transversely to the longitudinal direction of the band are arranged joints 15 parallel with one another, which attach the two walls 11*a*, 11*b* to one another and are joined to, or substantially reach as far as, the joint 13 arranged in the longitudinal direction of the band. The joints 13 and 15 thus delimit a number of pockets 16 arranged behind one another in the longitudinal direction of the band which are oriented transversely to the longitudinal direction of the band. The joints referred to above are realized, e.g. as welded or bonded joints.

The joints 15 situated transversely to the band terminate before they reach the connecting means 17*a*, 17*b* of the respective walls 11*a*, 11*b*. As a result a striplike area 19*a*, 19*b* is formed in the longitudinal direction of the band on each of the walls where these are not fixed to one another. This means that in an area 19*a* and 19*b* comprising the striplike area and the connecting means 17*a*, 17*b* in the first edge area 12 of the package band, the walls can be moved away from one another so as to facilitate access to the pockets 16.

Figure 4:
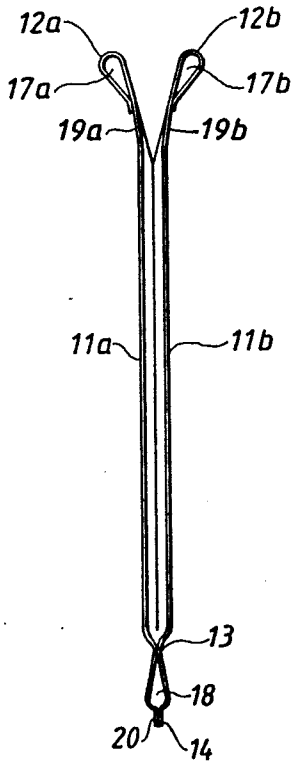
FIG. 4 is a section corresponding to section III—III showing an alternative embodiment of the package band, FIGS. 5*a–g* diagrammatically show the basic steps during the introduction of goods (components and/or parts) into a pocket in the package band.

In the embodiment shown in FIG. 4 the package band is formed by two separate bands of flexible material which are placed next to one another and are fixed to one another by a bottom joint 20, for example a bonded or welded joint in conjunction with the second edge area 14 of the package band. The bottom joint 20 constitutes the transition between the two walls 11*a*, 11*b* of the package band. For the rest the band is of a construction corresponding to that described in conjunction with FIGS. 1–3.

In certain embodiments the distance between the longitudinal joint 13 and the termination of the transverse joints 15 is chosen so that between the joints 15 and the joint 13 openings 22 are formed of a size which is adapted to the dimensions of a mechanical means, e.g. an arm or a finger, forming part of an emptying equipment for the discharge of good stored in the pockets 16. The joint 13 thereby represents an alternative embodiment of the second connecting means 18.

In certain applications the openings 22 completely replace the connecting means 18 in the second edge area 14 of the package band, whereas in other applications openings 22 as well as the connecting means 18 are included. In the embodiments where the package band lacks the connecting means 18 the openings 22 are formed alternatively between the termination of the transverse joints and the transition 23 into one another of the walls or between the termination of the transverse joints and the bottom joint 20. In these embodiments the openings 22 together with the transition 23, or alternatively the bottom joint 20 in the second edge area 14, form a connecting means corresponding to the connecting means 18 described earlier. Embodiments with the openings 22 are suitable primarily to be used when the goods stored in pockets of the band are of a rounded shape which prevents the mechanical means described in the preceding paragraph from hooking on to the goods when the means is moved inside the band.

Figure 5A:
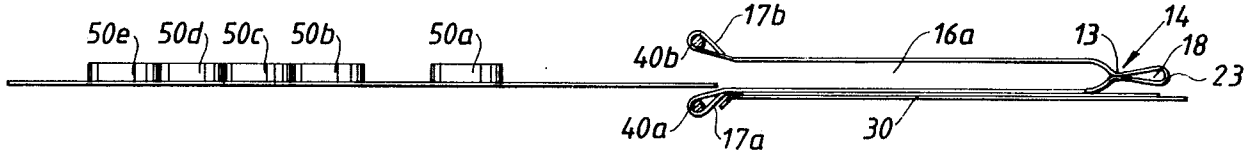
FIG. 5*h–i* are sectional views through the package band in alternative embodiments after its closure.
Figure 5B:
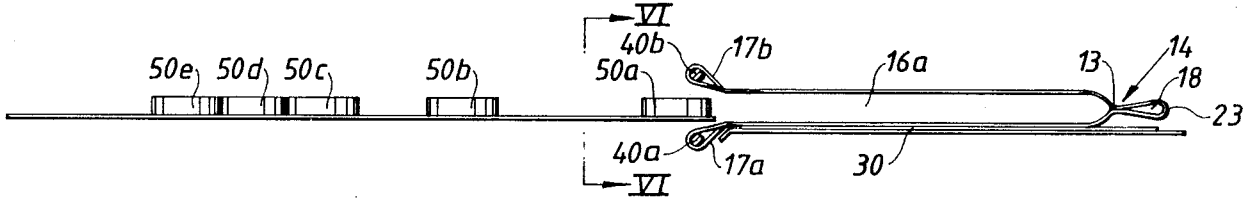
Figure 5C:
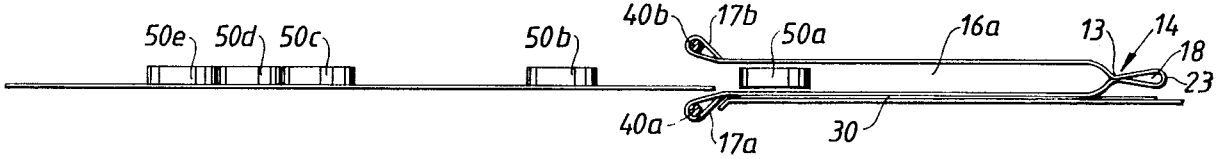
Figure 5D:
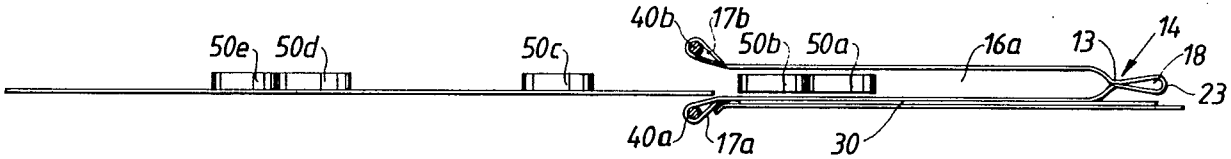
Figure 5E:
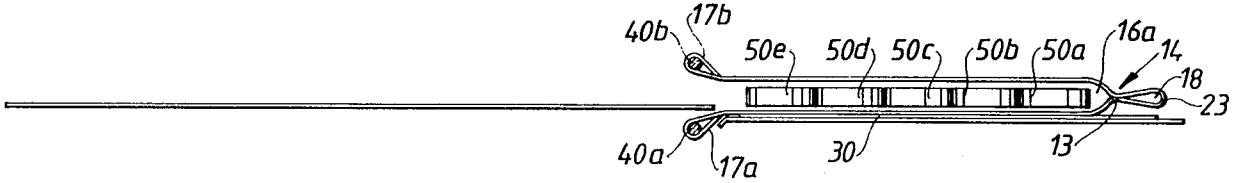
Figure 5F:
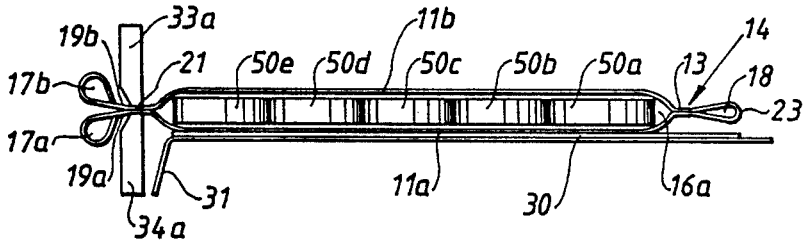
Figure 5G:
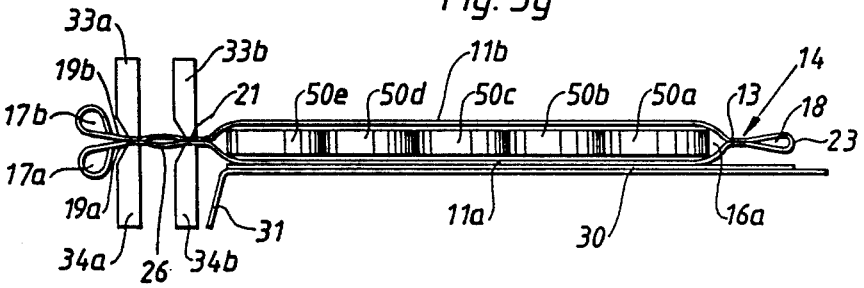
Figure 6:
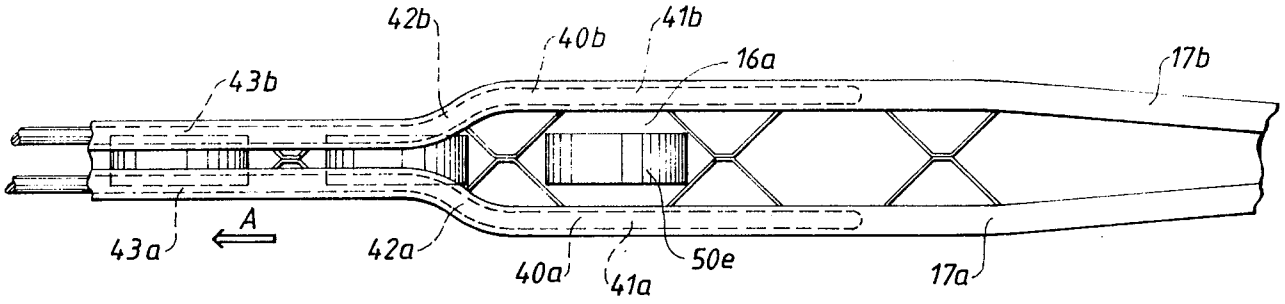
FIG. 6 is a sectional view of the package band together with an arrangement for the feeding of goods into pockets of the package band taken on line VI—VI in FIG. 5*b*.

In FIGS. 5*a–g* and in FIG. 6 is shown an example of a technique for the feeding of goods into pockets 16 of the package band and subsequent closure of the same. In FIGS. 5*a–e* are shown sectional views through the package band corresponding to section III—III in FIG. 1 during different stages of the feeding of goods into one (16*a*) of the pockets 16 of the package band, and FIG. 5*f–g* are sectional views through the package band during closure of the same after the goods have been filled into a pocket. The goods are represented by the items 50*a*–50*e*. For the feeding in of the goods a feeding board 30 is provided which in a preferred application is in the form of a belt conveyor with a direction of movement transversely to the plane of projection. In FIGS. 5*a–e* the package band is in a position which corresponds to the position shown in FIG. 6, whereas in FIGS. 5*f–g* it has been moved one or more steps to the left of the position shown in FIG. 6 so as to make possible the closure of the pocket 16*a* filled with goods and the feeding of goods into a subsequent pocket.

FIGS. 5*f–g* also show how in certain applications the transport band of the belt conveyor in this area and/or the feeding board has a bent-off part 31 so as to make room, for example, for welding dies 33*a*, 33*b*; 34*a*, 34*b* by means of which the two walls of the package band are fused together and are fixed to one another to provide a closure of the pocket filled with goods. In a preferred embodiment the welding dies are designed so that they sever at the same time the connecting means 17*a*, 17*b* alongside with, as a rule, adjoining parts of the striplike area 19*a*, 19*b* from the closed package band.

Figure 5H:
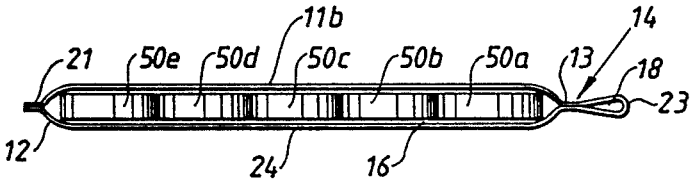
Figure 5I:
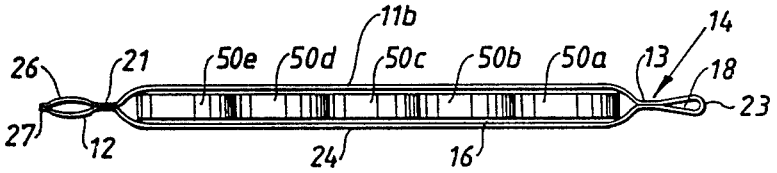

In FIGS. 5*h–i* is shown the package band 24 after it has been closed. In the application of the embodiment shown in FIG. 5*g* with two pairs of welding dies 33*a*, 34*a* and 33*b*, 34*b*, respectively the effect achieved is that in the edge area 12 a connecting means 26 shaped as a tunnel is formed. This embodiment of the closed package band is adapted so as to be used in applications where the goods stored in the package band have boundary surfaces of a shape whereby mechanical means of an emptying equipment can readily hook on the goods. The outermost joint between the two walls 11*a*, 11*b* of the package band is designated by numeral 27 and the innermost joint by 21. In embodiments where only one joint is formed (cf. FIG. 5*f*) the joint is designated by numeral 21.

In FIGS. 5–6 are shown forkshaped format arms 40*a*, 40*b* which are located in the connecting means 17*a*, 17*b* designed as tunnels of the walls 11*l*, 11*b* in the first edge area 12. Each one of the format arms comprises a first portion 41*a*, 41*b* which via a transition portion 42*a*, 42*b* passes over into a second portion 43*a*, 43*b*. The format arms in their first portions are located at a distance from one another, whilst in their second portions they are located more closely adjacent to one another. The package band is moved in the direction of the arrow A (FIG. 6) by means not shown in the Figure. The first portions of the format arms keep the connecting means 17*a*, 17*b* of the walls 11*a*, 11*b* away from each other as a result of which the pocket or pockets 16 which are in the corresponding part of the package band become accessible for the feeding in of goods. The FIGS. 5*a–e* show in principle how in this position items 50*a*–50*e* are successively moved into the pocket 16*a*. The feeding in takes place either purely manually or with the help of a device not shown in the Figures which preferably pushes the items in piece by piece. A succeeding item pushes an item already there towards the bottom of the pocket so that, when all items have been delivered, they occupy a position corresponding to that which is shown in FIG. 5*e*. In certain applications the package band has a vertical orientation, with the items dropping down into the pocket.

Figure 7:
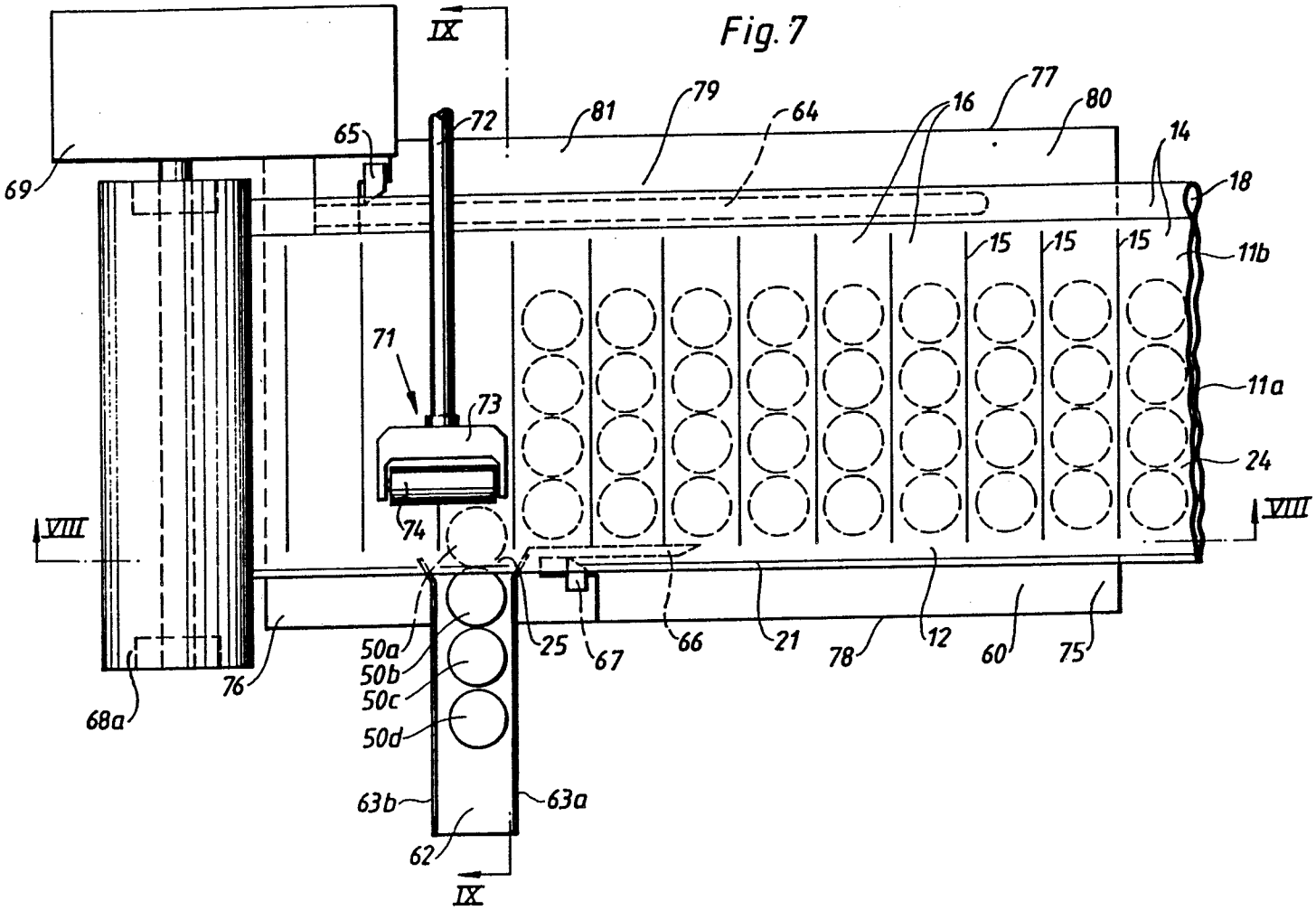
FIG. 7 is a view from above of the package band filled with goods during the discharge of goods from one of the pockets of the package band.
Figure 8:
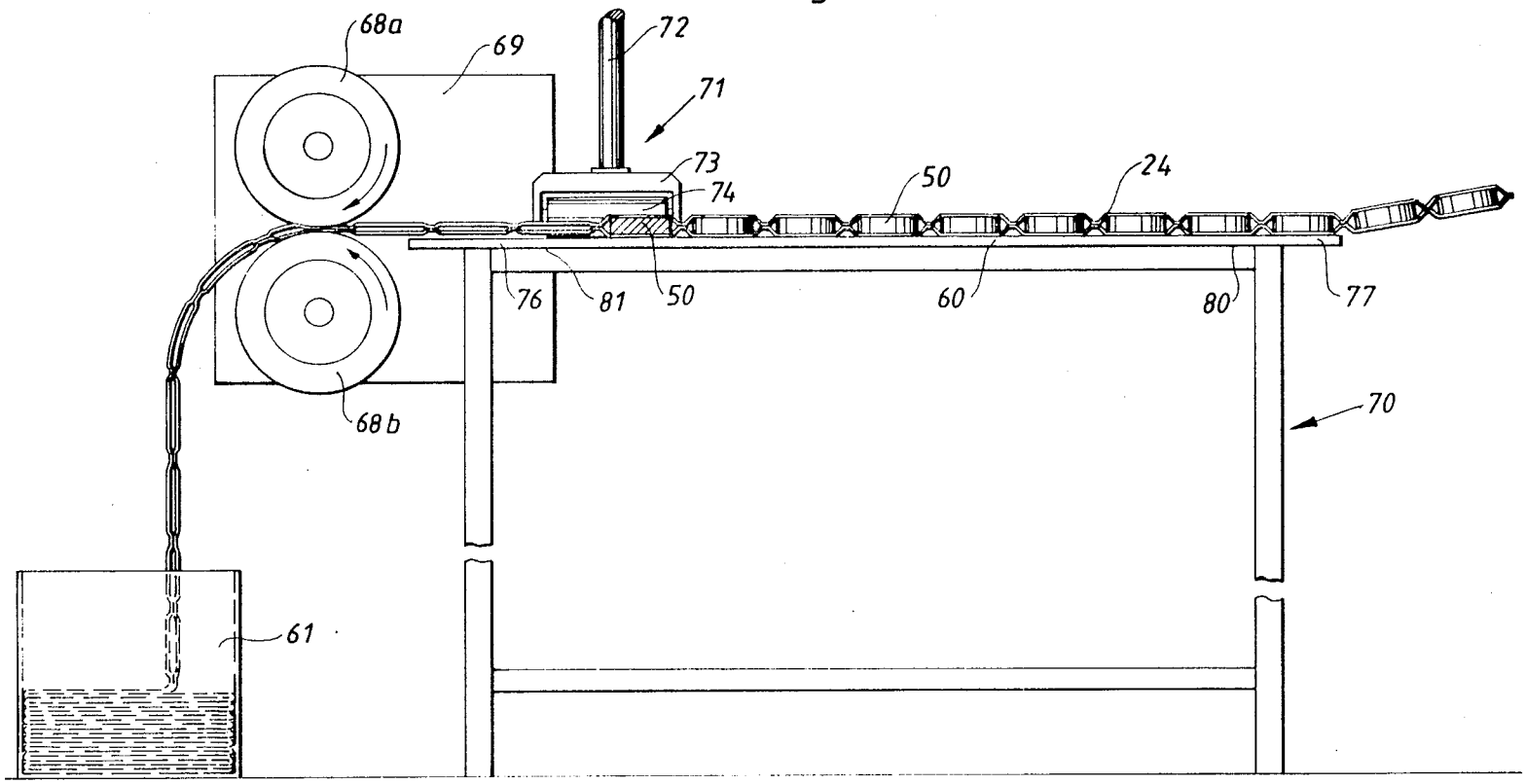
FIG. 8 is a section taken on line VIII—VIII in FIG. 7.
Figure 9:
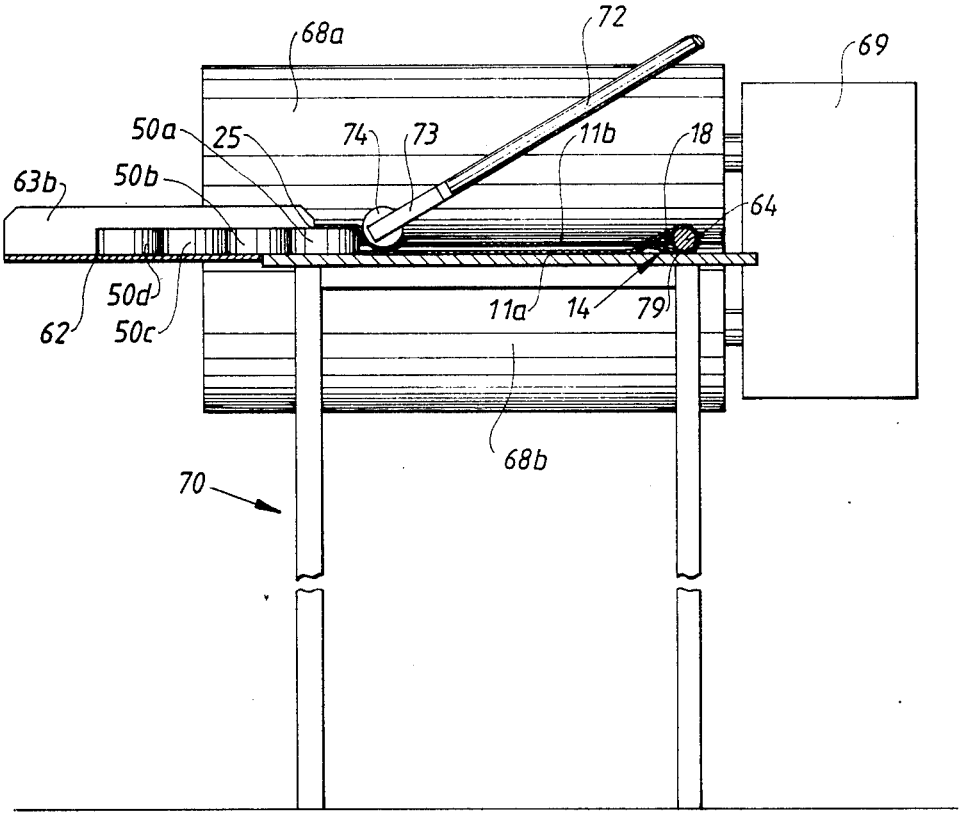
FIG. 9 is a section taken on line IX—IX in FIG. 7
Figure 10:
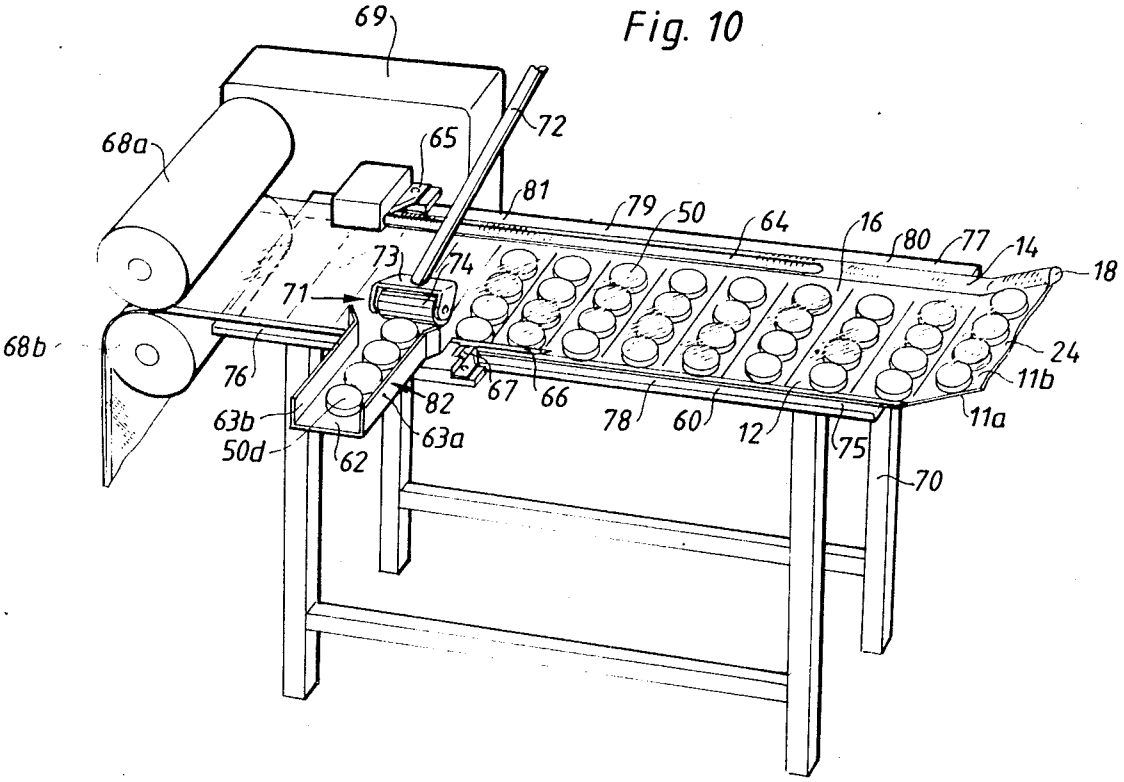
FIG. 10 is a perspective view of the arrangement in accordance with FIGS. 7–9 during discharge of goods from the package band.

Subsequently the package band is moved one or more steps towards the left in FIG. 6, and the pocket 16*a* provided with goods is closed by e.g. welding means 33, 34, so that the joint 21 and in certain applications also the outermost joint 27 are formed between the walls. The connecting means 17*a*, 17*b* in the first edge area of the respective wall, and in certain applications also adjoining parts of the striplike area 19*a*, 19*b*, are as a rule at the same time severed from the package band whilst a succeeding pocket 16 in the band occupies the position where goods are supplied to it. In the description which follows the reference numeral 24 will be used for a package band filled with goods (see FIG. 7).

In FIGS. 7–10 is shown an embodiment of an arrangement for the discharge of goods present in pockets 16 of the package band 24. The discharge arrangement comprises a stand 70 which supports a base 60, hereinafter referred to as a discharge base 60. This, as a rule, is constituted of a rectangular board or of a belt conveyor. The discharge base on the one hand has a first end area 75 situated in the feeding-in part 80 of the arrangement for the package band filled with goods, and on the other hand it has a second end area 76 which is situated in the discharge part 81 of the arrangement. The package band is moved from the first end area of the discharge base to its second end area in order to allow a discharging device 71 in an area in between to remove goods 50 from pockets 16 of the package band.

The arrangement includes a retaining means 64 which in the embodiments illustrated in the Figures is in the form of an arm located at a small distance from the boundary surface 79 of the discharge base 60 and adjoining a first edge area 77 of the discharge base. A first cutting means 65 is provided adjacent to the retaining means 64. In an area in conjunction with a second edge area 78 of the discharge base and at a small distance from its boundary surface 79, is provided a front retaining and control means 66, hereinafter referred to as control means. A second cutting means 67 is arranged adjacent to with the front control means 66. A receiving means 82 for goods discharged from the package band is arranged in proximity with the second edge area 78 of the discharge base. The receiving means is located in the area of the discharging device 71 so as to co-operate with the discharging device during the discharge of goods from the package band. In a preferred embodiment the receiving means is designed as a receiving track 62. Along at least one of its lateral edges the receiving board is bounded by a chute wall 63*a*, 63*b*.

The Figures illustrate the manner in which the discharging device 71 is arranged so that it can move substantially transversely to the direction of movement of the package band and in a direction towards and away from the receiving track 62. The discharging device according to the embodiment shown includes an arm 72 connected to fork 73 wherein is supported a contact means 74 which in the Figures is shown as a pusher roll 74. On displacement of the discharging device in the direction towards the receiving board the pusher roll describes a path along the discharge base 60.

In the Figures is shown an embodiment of the arrangement where a conveying means 68*a*, 68*b* for the movement of the package band is arranged in conjunction with the second end area 76 of the discharge base. The conveying means in the embodiment shown is constituted of two rotating rolls placed substantially on top of one another with matching direction of movement in the area where the circumferential surfaces of the rolls are located closest to one another. The rolls are supported in one or several motor and bearing housings 69.

When using the band in accordance with the invention the format arms 40*a*, 40*b* (see FIG. 6) are introduced into the separate connecting means 17*a*, 17*b* for the respective walls 11*a*, 11*b* for the purpose of the feeding of goods into pockets 16 of the band, whereupon the band is moved by the conveying means 68*a*, 68*b* along the format arms in the direction of the arrow A in FIG. 6. Since the format arms in the first portion 41*a*, 41*b* are situated at a distance from one another, the connecting means 17*a*, 17*b* occupy a position at a distance from one another, which means that the package pocket or pockets 16 which are in a position corresponding to the position of the first portion 41*a*, 41*b* of the format arms, will be accessible for the feeding in of goods. These goods, consisting of a number of items 50*a*–50*e*, are fed successively into the pockets, each succeeding item pressing the foregoing item in the direction towards the bottom of the pocket. In each application the dimensions of the pocket 16 are chosen so that the inner cross-section of the pocket in expanded state does not permit two items to be wholly or partly on top of one another. Similarly the length of the pocket is adapted to the combined length of the items intended for a pocket, in such a manner that the combined length of the items is only insignificantly less than the length of the pocket. Then the joint 21 and in certain applications also the outermost joint 27 are formed between the two walls in the striplike area 19*a*, 19*b*. The joint 21 being placed so that the distance to the nearest joint 15, arranged transversely to the longitudinal direction of the web, is less than the smallest dimension of the items. In this manner it is ensured that after closure of the pockets any movement of the items out of the pocket into which they have been introduced is prevented. The connecting means 17*a*, 17*b*, together with any superfluous material in the striplike areas 19*a*, 19*b*, are severed from the package band 24 filled with items and the package band 24 filled with goods has been formed.

When the package band 24 is to be emptied, it is passed to the arrangement according to FIGS. 7–10. As a rule the package band is drawn by means of the conveying means 68*a*, 68*b* from the feeding-in section 80 of the arrangement to the discharge section 81 of the arrangement. At the start of the feeding in of the package band the connecting means 18 of the package band is guided into a position so as to co-operate with the retaining means 64. At the same time the front control means 66 is introduced into the closed package band adjoining the closure 21 and occupies there a position alongside the package band between the two walls 11*a*, 11*b* in the region of the striplike area 19*a*, 19*b*. The retaining means 64 and the front control means 66 ensure that the package is extended transversely to the longitudinal direction of the track. During the continued travel of the package band in the direction towards the second end area 76 of the discharge base the second cutting means 67 opens the package band adjoining the joint 21 formed at the closure of the package band. As a result the pockets 16 are opened so as to allow goods which are stored in them to leave the pockets.

When the first pocket 16 with components reaches the position opposite the receiving means 82 (receiving board or receiving track 62) the contact means 74 of the discharging device is moved transversely to the longitudinal direction of the package band whilst resting against the second wall 11*b* of the package band which in turn is pressed by the contact means against an edge or wall of the component stored in the pocket farthest from the opening of the pocket, said edge or wall facing towards the contact means. As a result the components are pushed out of the pocket by the contact means and are placed e.g. on the receiving board 62. When the package band has been advanced one position, the next pocket is emptied of its contents.

During the movement towards the discharge end of the arrangement the connecting means 18 located in the second edge area 14 of the package band passes the first cutting means 65 which opens the connecting means 18. This makes it possible for the band to leave the retaining means 64. The band thereafter continues between the two conveying means 68*a*, 68*b* and the used band is stored, e.g. in a container 61.

In some embodiments of the package band one or more of the connecting means 17*a*, 17*b*, 18 or 26 are in the form of material thickenings. During the filling and/or emptying of the pockets 16 the walls of the package band in these cases pass through slits e.g. in the walls of pipes. The width of the slits in these cases is chosen so that the material thickenings are prevented from slipping through the slits. In such embodiments, the retaining means 64 and the control means 66 respectively are provided with slits and are thereby adapted to the package band just described.

We claim:

1. A package band comprising two walls of flexible material in adjoining relation, said walls having first and second edge regions extending longitudinally of the band, first connecting means joining said walls together at said second edge region to provide a longitudinal joint thereat, means providing a succession of transverse joints spaced longitudinally of the band at which the walls are joined together to form with said longitudinal joint a succession of storage pockets longitudinally of the band, said walls at said first edge region being disconnected to permit access to said storage pockets for goods to be inserted into and removed from said pockets, and second connecting means at said second edge region for forming a continuous opening extending longitudinally of the band externally of said longitudinal joint and said pockets, said walls each including at said first edge region a connection forming a tunnel extending longitudinally of the band.

2. A package band as claimed in claim 1 wherein said opening formed by said second connecting means defines a further tunnel.

3. A package band as claimed in claim 1 wherein said transverse joints and said longitudinal joint define a second continuous opening extending longitudinally of the band.

4. A package band as claimed in claim 1 wherein said first connecting means comprises a longitudinal joint joining said walls together at ends thereof.

5. A package band as claimed in claim 1, said transverse joints having ends spaced transversely from the tunnels at the ends of the walls.

* * * * *